United States Patent [19]

Geleziunas

[11] Patent Number: 4,787,582

[45] Date of Patent: Nov. 29, 1988

[54] DEVICE FOR HOLDING PLANAR IMPLEMENTS

[76] Inventor: Rimas J. Geleziunas, 3900 Yonge Street, Toronto, Ontario, Canada, M4N 3N6

[21] Appl. No.: 49,475

[22] Filed: May 14, 1987

[51] Int. Cl.[4] ..... A47G 21/14

[52] U.S. Cl. ..... 248/37.3; 211/70.7; 248/309.1

[58] Field of Search ..... 248/37.3, 37.6, 360, 248/359 R, 359 F, 316.2, 309.1; 211/70.7, 60.1; 24/523

[56] References Cited

U.S. PATENT DOCUMENTS

| | | | |
|---|---|---|---|
| 1,614,342 | 1/1927 | Bleckley | 248/37.6 |
| 2,357,646 | 9/1944 | Gilbert | 248/37.6 |
| 2,459,391 | 1/1949 | Otis | 211/70.7 X |
| 3,305,100 | 2/1967 | Barbee | 248/37.6 X |
| 3,889,809 | 6/1975 | McNair | 211/70.7 X |
| 4,294,421 | 10/1981 | Kunstlicher et al. | 248/37.6 |
| 4,561,548 | 12/1985 | Call | 211/70.7 |

FOREIGN PATENT DOCUMENTS

| | | | |
|---|---|---|---|
| 595056 | 3/1960 | Canada | 248/37.6 |

*Primary Examiner*—Ramon S. Britts
*Assistant Examiner*—Karen J. Chotkowski
*Attorney, Agent, or Firm*—Rogers, Bereskin & Parr

[57] ABSTRACT

A device for holding planar implements, for example knives, has a body. The body has a portion extending horizontally outwardly from it, and defining a number of vertical slots. For each slot, there is a number of gripping elements, and a spring urging the grippinig elements into the slot, for grasping a planar implement or knife. Each gripping element can be generally channel-shaped and include flanges projecting through openings of a side wall of a slot. The body can be shaped to include an intermediate part spaced rearwardly from the portion and a lower, forwardly projecting lip. This ensures that handles of knives or other gripping elements are spaced from the intermediate part, to enable them to be readily grasped. The gripping elements define a tapered entry zone, so that a knife can be inserted simply by pushing it into a slot.

17 Claims, 2 Drawing Sheets

DEVICE FOR HOLDING PLANAR IMPLEMENTS

FIELD OF THE INVENTION

This invention relates to a device for holding planar implements, and more particularly this invention relates to a knife holding device, for use in a kitchen.

BACKGROUND OF THE INVENTION

There are many activities where a number of different knives are required. For example, in most kitchens, it is desirable to have a number of different knives of different sizes. For various reasons, it is desirable to store the knives carefully. Firstly, for safety reasons, it is desirable that the knives are stored safely, to minimize the chance of accidentally cutting oneself, or in the case of a domestic kitchen, to prevent young children playing with the knives. It is also desirable to have the knives ready to hand, for use as required. It is undesirable to store knives with other kitchen implements simply in a drawer, as the sharp edge of a knife is quickly dulled by contact with other implements.

Proposals have been made for knife storing devices. However, many known arrangements suffer from various disadvantages. Thus, one proposal is a simple wooden block including a number of elongate recesses extending downwardly at an angle into the block. The block is made from wood. Each knife is stored simply by inserting it into an empty recess in the block.

This has the disadvantage of taking up space on a countertop. Also, the configuration does not promote the clean, hygienic storage of knives, since the recesses in the block can become dirty, and are not easy to clean.

What is desirable is a knife holder that will store knives, or the planar implements, away from other implements. Such a device should preferably not occupy counter space in a kitchen.

In accordance with the present invention, there is provided a device, for holding a plurality of planar implements, the device comprising: a body, which includes a portion extending laterally outwardly therefrom; a plurality of generally vertical slots in said portion; and, or each slot, a plurality of gripping elements disposed on either side of the slot, the gripping elements defining an entry zone that tapers inwards to enable the gripping elements to be urged apart by insertion of a planar implement, and a spring means urging the gripping elements together for gripping a planar implement.

The device of the present invention can be configured for mounting on a wall. Thus, a main part of the body can be vertical, with the portion with the slots extending horizontally and forwardly from it. When mounted on a wall, this enables a plurality of knives or the like to be readily stored.

Since the knives or other implements are suspended vertically, it is simply necessary to provide enough gripping force to counter the weight of the knives. The gripping elements do not have to retain each knife at a particular angular orientation. Indeed, it is acceptable for the weight of the handle of each knife to cause it to swing to a position in which the centre of gravity is below the gripping point.

BRIEF DESCRIPTION OF THE DRAWINGS

For a better understanding of the present invention, and to show more clearly how it may be carried into effect, reference will now be made, by way of example, to the accompanying drawings, in which.

DESCRIPTION OF THE PREFERRED EMBODIMENT

Figure 2:
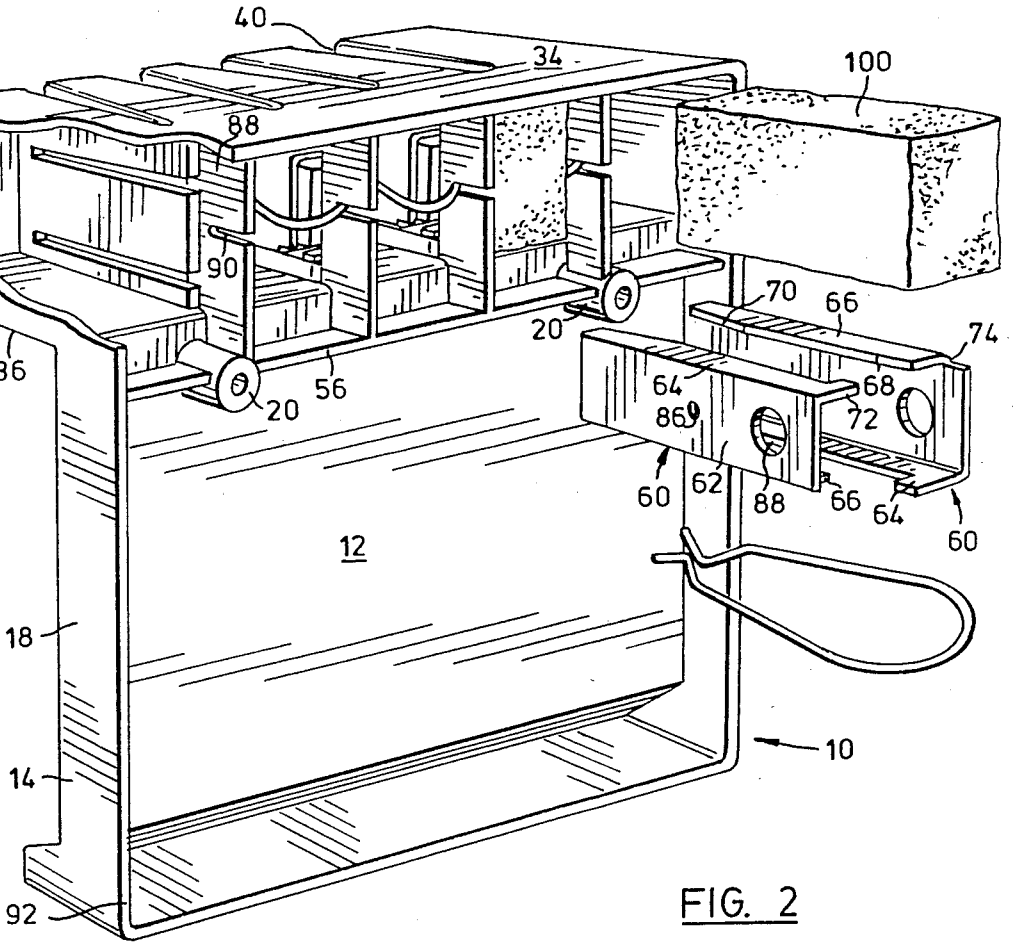
FIG. 2 is a perspective view of the device of FIG. 1, on a larger scale, and partially exploded and partially in section.

In the drawings, the device of the present invention is generally denoted by the reference 10. The device 10 is shown in use as a knife holder, although it is to be appreciated that it could be used to hold any generally planar or flat implement, for example a slice. Further, whilst the device is described in use in a kitchen environment, it could be used in other situations.

The device 10 has a body 12. The body 12 is integrally mounted in one piece from a plastic material. The body 12 comprises a rear, vertical part 14, for mounting the device 10 to a wall or other surface. The rear vertical part 14 has a front face 16 and two side faces 18. Towards the top thereof, it includes two recesses 20, provided with openings for screws or the like.

At the bottom of the device 10, there is a forwardly projecting lip 22, which is continuous with the rear vertical part 14. The sides 18 of the vertical part 14 continue down the sides of the lip 22.

At the top of the device 10, there is an upper portion 30 which extends horizontally, in this case forwardly, out from the rear vertical part 14. The upper portion 30 has side faces 32, which are continuous with the side faces 18. The upper portion 30 further has a top face 34, a bottom face 36 and a front face 38.

Figure 3:
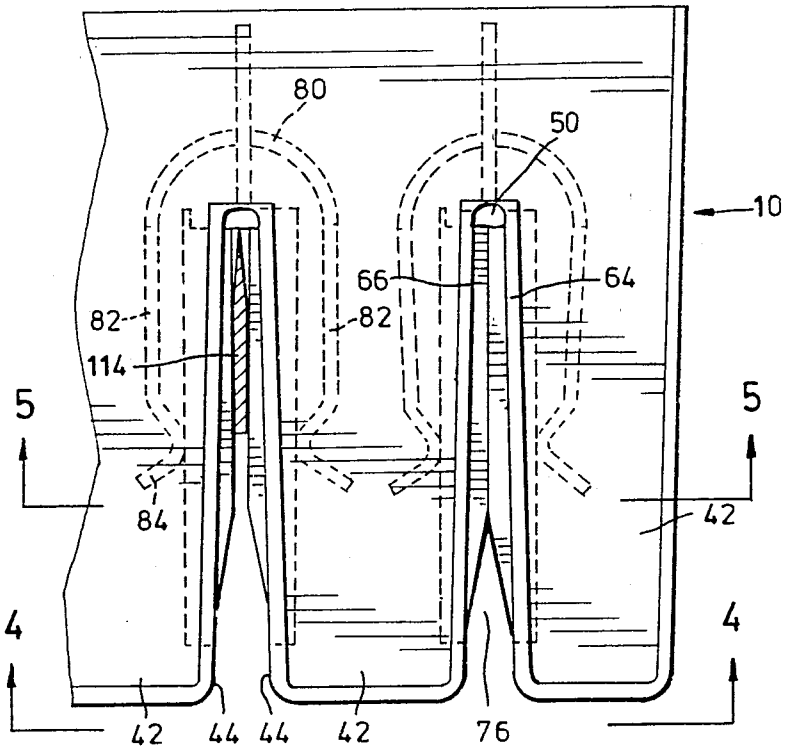
FIG. 3 is a plan view of part of the device of FIG. 1 on a larger scale.

In this upper portion 30, there are four vertical slots 40. The slots 40 divide the front part of the upper portion 30 into five projections 42. As shown in FIG. 3, each slot 30 tapers, so as to narrow in a rearwards direction.

Each slot 30 is defined by side walls 44 of adjacent projections 42. Each side wall 44 has a major, central section 46, which is set back from top and bottom sections 48, this set back being zero at the rear of the slot and increasing towards the front. At the rear of each slot 30 and at the top thereof, there is a protrusion 50 limiting penetration into the slot 40.

At the top and bottom of each major central section 46 of each side wall 44, there are two elongate, horizontally extending openings 52.

For each slot 40, a pair of gripping elements 60 is provided, the gripping elements 60 being most clearly shown in FIG. 2. Each gripping element 60 comprises a planar vertical part 62, an first flange 64, and a second flange 66. Each gripping element 60 is formed by stamping from sheet steel or the like. The flanges 64, 66 are elongate and horizontal, and have generally corresponding profiles. Thus, each flange 64, 66 includes a central edge 68, which is parallel to the vertical part 62, and an inclined front edge 70.

With reference to the orientation as shown in FIG. 2, the left hand gripping element 60 has its first flange 64 at the top and its second flange 66 at the bottom;

whereas the flanges are reversed for the right hand gripping element 60, with the first flange 64 at the bottom and the second flange 66 at the top. Each first flange 64 includes a tab 72 extending towards the other gripping element 60. Correspondingly, to receive a respective tab 72, the second flange 66 includes a step 74, terminating the flange 66 before the rear of the gripping element 60. These steps 74 and the tabs 72 engage one another, as detailed below, to help keep the gripping elements 60 aligned.

Figure 4:
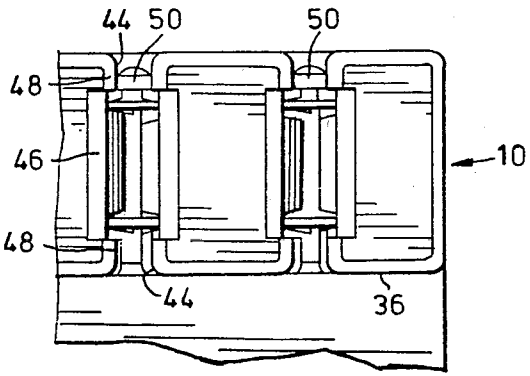
FIG. 4 is a view in the direction of arrows 4—4 of FIG. 3.
Figure 5:
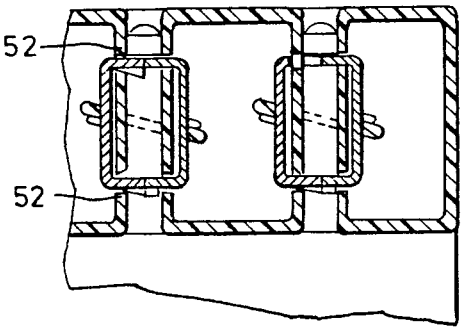
FIG. 5 is a sectional view along the line 5—5 of FIG. 3.

As shown in FIGS. 4 and 5, for each slot 40, a pair of gripping elements 60 are inserted into the openings 52 of the side walls 44. The flanges 64, 66 then project through the openings 52. The central edges 68 of the flanges either abut one another, as shown for the right hand slot 40 in FIG. 3, or overlap one another. The tabs 72 and steps 74 engage one another, to align each pair of gripping elements 60 relative to one another. The front edges 70 of the flanges 64, 66 define an entry zone 76, that tapers rearwardly. The gripping elements 60 are located below the protrusion 50.

To secure each pair of gripping elements 60 in position, a U-shape spring clip 80 is provided. The spring clip 80 has side legs 82, and curved end parts 84. As shown in FIG. 2, each gripping element 60 additionally includes, in its central part 62, an aperture 86, in which one end part 84 of the clip 80 is received. The gripping element 60 can include additional openings 88, if desired.

To further locate each spring clip in position, within the upper portion 30, there is a vertical web 88 extending rearwardly from the end of each slot 40. Each web 88 includes a slit 90. Each spring clip 80 is then located in a respective slit 90, with its curved end parts 84 received in the apertures 86.

To further secure the gripping elements 60 in position, blocks 100 of a firm, resilient plastic material are provided. Each block 100 is inserted into one of the projections 42, to help secure the spring clips 80 and gripping elements 60 in position. The blocks 100 additionally serve to provide acoustic damping of any sound generated.

As shown in FIG. 2, the body 12 is hollow as viewed from the rear. The body 12 is integrally formedin one piece from an ABS plastic. As such, the various faces etc. of the body 12 are formed from walls having a generally uniform wall thickness. A cross member 56 extends between the side faces 18 and the recesses 20. The webs 88 extend down to the cross member 56. The rear edges of the side faces 18, the top face 34 and the bottom face of the lip 22 form a rear mounting plane 92. The device 10 is mounted with the mounting plane 92 against a wall, secured by screws located in the recesses 20.

Figure 1:
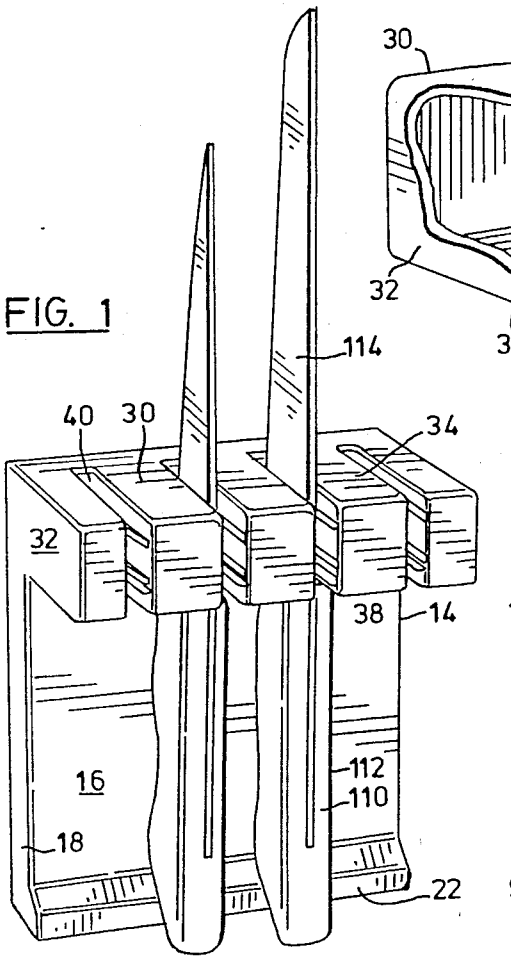
FIG. 1 is a perspective view of a device according to the present invention, in use.

In use, with the device 10 mounted on a wall, knives 110 can be inserted, as shown in FIGS. 1 and 3. Each knife 110 has a handle 112 and a blade 114.

A knife 110 is inserted, simply by placing its blade 114 in the entry zone 76. The blade 114 is then pressed against the gripping element 60. The tapered front edges 70 are then urged apart, to enable the blade 114 to be pushed to the rear of the respective slot 40, as shown for the left hand slot 40 in FIG. 3. The blade 114 can be pushed rearwardly, until it abuts the protrustion 50.

At the same time, the handle 112 is pushed rearwardly, until it contacts the forwardly extending lip 22. The lip 22 serves to keep the handle 112 spaced from the front face 16.

The knife 110 is then held by the device 10. The gripping elements 60, acted upon by the clip 80 and respective resilient blocks 100, provide sufficient gripping force to retain the knife. It is to be noted that the angles of the front edges 70 can be such that little or no marring of the cutting edge of the knife blade 114 occurs. In any event, the vertical extent of the flanges 64, 66 is small, so that any such marring will be slight.

As each handle 112 is kept spaced from the face 16, this facilitates removal of the knife 110. A user can readily grasp the handle 112, and then pull the knife out of the respective slot 40. As the knife 110 is removed, the gripping elements 60 spring back into the position shown in the right hand slot 40 of FIG. 3.

I claim:

1. A device for holding a plurality of planar implements, the device comprising:

a body, which includes a portion extending horizontally outwardly therefrom;

a plurality of generally vertical slots in said portion with each slot including a pair of facing side walls, each of which includes an elongate opening; and for each slot, a pair of gripping elements disposed on either side of the slot, each gripping element including an elongate flange that extends through a corresponding opening, with the flanges facing one another and shaped to define an entry zone that tapers inwards, to enable the gripping elements to be urged apart by insertion of a planar implement; and a spring means urging the gripping elements together to grip side faces of a planar implement between their flanges.

2. A device as claimed in claim 1, wherein said portion includes side walls, with each slot being defined by a pair of side walls, and wherein each side wall includes an opening through which a gripping element extends.

3. A device for holding a plurality of planar implements, the device comprising:

a body having a rear mounting face and a portion extending horizontally and forwardly out therefrom;

a plurality of generally vertical slots in said portion, with each slot including a pair of facing side walls, each of which includes two elongate, horizontal openings located one above the other, with each opening located opposite an opening in the opposite side wall;

for each slot, a pair of gripping elements, each of which is located mainly within said portion and includes upper and lower horizontal elongate flanges extending through corresponding openings in a respective side wall, the flanges including inclined forward edges that define an entry zone that tapers inwards to enable a planar implement to be inserted between the gripping elements;

a spring means for each slot within said portion urging the gripping elements for that slot together, whereby a planar implement between the respective gripping elements is gripped and held by the flanges thereof.

4. A device as claimed in claim 3, wherein each gripping element has a generally channel-shaped vertical cross-section.

5. A device as claimed in claim 4, wherein each flange includes a straight central edge, and at the front thereof, a front edge inclined at an obtuse angle to the central edge, the front edges of the gripping elements defining the entry zone that tapers inwards.

6. A device as claimed in claim 5, wherein, for each slot, the spring means includes a spring clip located within said portion and including side legs which abut the gripping elements and urge them together.

7. A device as claimed in claim 6, wherein, for each slot, each of the gripping elements includes an aperture, and each side leg of the spring clip includes an end part engaging that aperture.

8. A device as claimed in claim 7, wherein said portion includes, for each slot, a web extending rearwardly therefrom, and each web includes a slit in which a respective spring clip is located.

9. A device as claimed in claim 5, wherein, for each slot, the pair of gripping elements have corresponding shapes, and each gripping element has a first flange including a tab extending towards the other gripping element, and a second flange which includes a step terminating that flange before the rear of that gripping element, the tab of one first flange engaging the step of the second flange of the other gripping element.

10. A device as claimed in claim 3, 4 or 9, wherein, for each slot, the spring means includes a U-shape spring clip located within said portion and including side legs which abut the gripping elements and urge them together.

11. A device as claimed in claim 6, 7 or 8, wherein the spring means additionally includes a plurality of resilient blocks, with each resilient block located in said portion between gripping elements of adjacent slots, urging the gripping elements into the slots.

12. A device as claimed in claim 5, 6 or 7, wherein the side wall of each slot comprises a major, central section extending horizontally, and top and bottom sections extending horizontally above the central section, with the central section set back from the top and bottom sections.

13. A device as claimed in claim 5, 6 or 7, wherein each side wall comprises a major, central section that extends horizontally, and top and bottom sections extending horizontally above and below the central section, with the central section set back from the top and bottom sections, and with said openings provided in the major, central section, and wherein, for each slot, said portion includes a protrusion at the rear of that slot.

14. A device as claimed in claim 1, 5 or 6, wherein said portion is provided at the top of the body, and the body includes a forwardly projecting lip at the bottom thereof and an intermediate part extending between said portion and the forwardly projecting lip, the lip spacing planar implements from the intermediate part.

15. A device as claimed in claim 1, 5 or 6, wherein said portion is provided at the top of the body, and the body includes a forwardly projecting lip and an intermediate part extending between said portion and the forwardly projecting lip, the intermediate part including a vertical, planar front face, and the forwardly projecting lip spacing planar implements from the intermediate part.

16. A device as claimed in claim 15, wherein the body defines a vertical, rear mounting plane.

17. A device for holding a plurality of planar implements, the device comprising:

a body which is an integral moulding, and which comprises an upper portion, an intermediate part extending down from the upper portion and including a plane, front face, and a forwardly-projecting lip below the intermediate part and extending forwardly of the front face;

a plurality of informly-spaced vertical slots in said upper portion, each slot including a pair of opposed side walls, and each side wall including two horizontally elongate openings located one above the other;

for each slot, a pair of gripping elements, each of which has a channel-shaped vertical cross-section and includes flanges extending through respective openings into the respective slot, with each flange including a straight, central edge and an inclined front edge at an obtuse angle to the central edge, the front edges of the flanges defining an entry zone that tapers rearwardly, to enable a planar implement to be inserted urging the gripping elements apart; and for each slot a spring clip located within the portion and abutting respective gripping elements to urge them together.

* * * * *